United States Patent [19]

Moore

[11] Patent Number: 4,712,673

[45] Date of Patent: Dec. 15, 1987

[54] COMBINATION FOOD CARRIER AND AMUSEMENT DEVICE

[75] Inventor: Richard A. Moore, Marietta, Ga.

[73] Assignee: Western Publishing Company, Inc., Racine, Wis.

[21] Appl. No.: 846,075

[22] Filed: Mar. 31, 1986

[51] Int. Cl.[4] ..... B65D 25/30; B65D 77/02; B65D 77/04

[52] U.S. Cl. ..... 206/232; 206/459; 206/315.1; 206/542; 190/1; 383/4; 229/52 B; 229/103; 426/411

[58] Field of Search ..... 206/232, 542, 459, 315.1; 190/1; 229/103, 52 B; 383/4

[56] References Cited

U.S. PATENT DOCUMENTS

| | | | |
|---|---|---|---|
| 1,627,583 | 5/1927 | Thum | 229/52 B |
| 1,683,678 | 9/1928 | Kitterman et al. | 383/4 X |
| 3,044,211 | 7/1962 | Palm | 229/52 B |
| 3,126,145 | 3/1964 | Struble | 229/52 B |
| 4,372,077 | 2/1983 | Balbuen | 46/116 |
| 4,434,889 | 3/1984 | Fery | 206/216 |
| 4,487,590 | 12/1984 | Becker et al. | 446/147 |
| 4,648,548 | 3/1987 | Shin | 206/459 X |

FOREIGN PATENT DOCUMENTS

| | | | |
|---|---|---|---|
| 269963 | 11/1950 | Switzerland | 229/52 B |
| 569902 | 6/1945 | United Kingdom | 383/4 |
| 2066209 | 7/1981 | United Kingdom | 206/459 |

*Primary Examiner*—William Price

*Attorney, Agent, or Firm*—Karen M. Gerken; Martin P. Hoffman; Mitchell B. Wasson

[57] ABSTRACT

A combination food carrier and amusement device comprising first and second panels having a removable bag member and a book secured to the inner surfaces thereof. The first and second panels are provided with removable handle portions which enable the device to transport food items retained in a bag member. The bag member and the handle portions are disposable so that the device remains as a unique amusement device and book.

17 Claims, 6 Drawing Figures

FIG. 1.
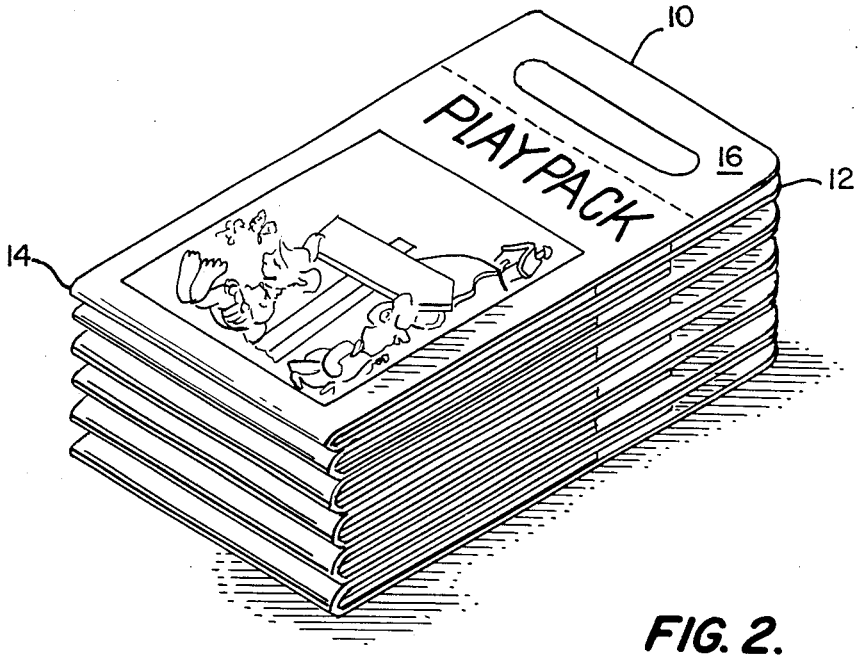
FIG. 2.
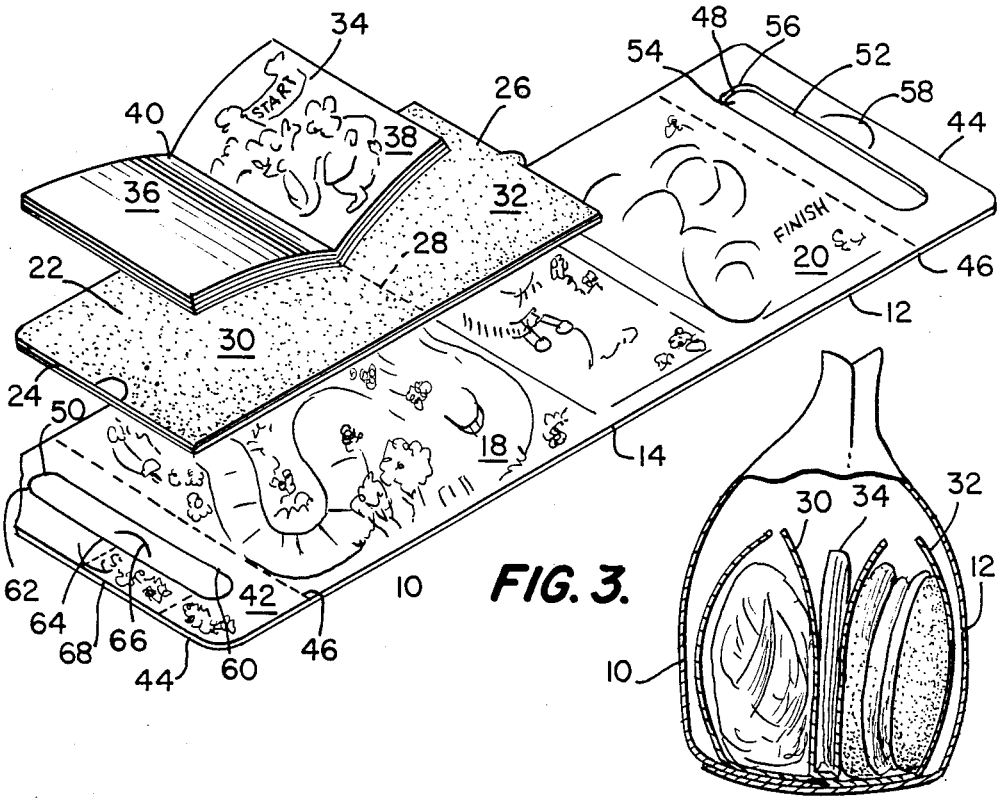
FIG. 3.

COMBINATION FOOD CARRIER AND AMUSEMENT DEVICE

BACKGROUND OF THE INVENTION

1. Field of the Invention

The present invention relates to a combination food carrier and amusement device for utilization in fast food restaurants and other like eating establishments. Eating establishments, and fast food restaurants in particular, have traditionally sought to attract the patronage of families with children. The appeal to this market segment has focused on the provision of moderately priced tasty food with quick and courteous service in an attractive atmosphere. Additionally, fast food restaurants typically offer various amusement devices for children in the form of cups and glasses, placemats, hats and bibs. Such amusement devices are designed to serve a useful purpose as well as to interest a child during the course of the meal and to thereby insure that the child, and hence the parents, enjoy a pleasant and memorable eating experience. An amusement device which is non-disposable is particularly desirable as it serves the further purpose of creating lasting good will and marketing appeal for the distributing establishment.

The subject invention is directed to a novel amusement device and children's book which also functions as a carrier for various food items, such as hamburgers and french fries. The combination food carrier and amusement device may be folded and kept in stacks on the counter of a fast food or other like restaurant. The food items are inserted into and retained by grease resistant bags inside the carrier, which is provided with a handle portion for easy transport. The interior of the food carrier is provided with an integral children's book and a variety of puzzles and games to which access is gained when the food carrier is opened. The food carrying bag member and the handle portions may be removed so that the book, games and puzzles remain as a unique and enduring amusement device. The food carrier may be adapted such that it stands in a vertical position on a support surface when assembled with the food items inserted therein.

2. Description of the Prior Art

A collapsible receptacle which is removably attached to a greeting card is known in the prior art. U.S. Pat. No. 4,434,889 discloses a multi-panel greeting card to which is affixed a folded, collapsed receptacle. The receptacle may be removed from the greeting card, unfolded, and utilized as a carrier by means of handles provided at the top of the receptacle.

The prior art also discloses an amusement device comprising, in combination, a storybook, a flannel board, figures and a puppet. U.S. Pat. No. 4,372,077 is directed to a merchandisable packet wherein a puppet is constructed so that a book, a flannel board and flannel board figures fit within the body of the puppet in an area below the head.

U.S. Pat. No. 4,487,590 discloses a children's book having cooperable printed matter, such as a steering wheel, and structural features, such as openings formed adjacent the edge of the steering wheel, so that a child may place his fingers through the openings and, in effect, grasp the steering wheel.

SUMMARY OF THE INVENTION

The combination food carrier and amusement device of the present invention comprises generally rectangular first and second panels connected by a central fold line. Each panel is adapted to be folded inwardly toward and over the other panel to a folded position wherein the outer surface of the first panel faces upwardly when the carrier rests on a support surface. The outer surface of the first panel is provided with an appropriate amusing title and/or scene. The inner surfaces of each panel, which are exposed when the carrier is opened by moving the panels outwardly and away from each other, are inscribed with a variety of puzzles and games. A bag member is provided between the inner surfaces of the panels and is capable of accepting and retaining food items such as hamburgers and french fries. The bag member may be formed of grease resistant material or may be chemically treated to achieve the same effect. A children's book, comprising a plurality of left hand and right hand pages, is similarly disposed between the first and second panels. The book, as well as the panels, may be formed of grease resistant materials or may be similarly treated.

The first and second panels are each provided with a handle portion proximate their external edges opposite the fold line. The handle portion of each panel is defined by the external edge of the panel and by a line of perforations provided on each panel proximate its external edge. A handle mechanism is formed on each handle portion between the line of perforations and the external panel edge. The handle mechanism comprises, in combination, an aperture formed in the second panel and a corresponding partially cut out portion provided on the first panel. When the interior bag portions are filled with food items, the carrier may be closed by folding the first and second panels inwardly toward each other. The partially cut out portion provided on the first panel is inserted into the aligned aperture formed in the second panel so that the partially cut out portion extends through the aperture and is folded upwardly against the outer surface of the second panel. A locking means is provided whereby the handle mechanism is locked in place. The carrier thus provides a novel and efficient means for transporting various food items, being particularly adapted for use as a carrier by children.

After the device has been utilized as a carrier for the food items, has been opened, and the food items removed, the interior bag portions may be removed. Similarly, the handle portions on each panel may be removed by severing them from their respective panels by tearing along the lines of perforations provided on the panels. The subject food carrier thus becomes a unique and interesting children's book and amusement device of enduring value.

DESCRIPTION OF THE DRAWINGS

FIG. 1 shows a plurality of the combination food carrier and amusement devices of the present invention as they appear vertically stacked on a counter or support surface of a fast food or other like restaurant.

FIG. 2 is a perspective view of the preferred embodiment of the combination food carrier and amusement device in open position and depicting the arrangement of its parts.

FIG. 3 is a view of the interior of the combination food carrier and amusement device in a closed position showing the food items being retained and carried therein.

DESCRIPTION OF THE PREFERRED EMBODIMENT

Figure 4:
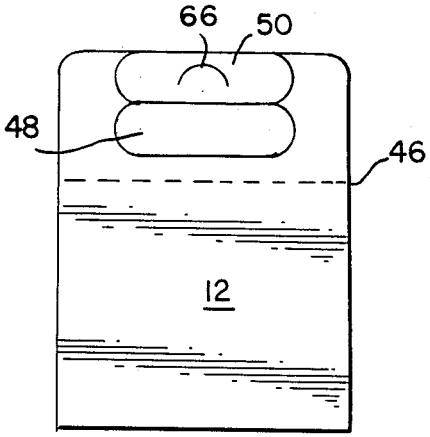
FIG. 4 is a rear view of the combination food carrier and amusement device in a closed position and illustrating the handle mechanism and locking means.

Referring now to the drawings, the preferred embodiment of the combination food carrier and amusement device of the present invention comprises generally rectangular first and second panels 10,12, respectively, connected by a central fold or score line 14 as best illustrated in FIG. 2. Each panel is adapted to be folded inwardly toward and over the other panel to a folded, closed position wherein the outer surface 16 of the first panel faces upwardly when the subject carrier is vertically stacked on a counter or other support surface of a fast food or other like restaurant as shown in FIG. 1. The outer surface 16 of the first panel is provided with an appropriate amusing title and/or scene. As best depicted in FIG. 2, the inner surfaces 18,20 of the respective first and second panels are exposed when the carrier is opened by moving the panels outwardly and away from each other. The inner surface of each panel is inscribed with a variety of puzzles and games. A bag member 22, open at ends 24,26, and provided with a transverse line of perforations 28, is disposed over the inner surfaces of the first and second panels so that the line of perforations on the bag member is aligned with the central fold or score line 14 connecting the panel members. Portions of the bag member 30,32 extend beyond the fold line on each side and are proportioned, respectively, to accept and retain fast food items, such as hamburgers and french fries. In order to protect adjacent surfaces of the carrier, the bag member may be formed of a grease resistant or other like material or may be chemically treated with a grease repellent. The first and second panels of the carrier may be similarly treated.

A children's book 34 comprising a plurality of left hand and right hand pages 36,38 separated by a central fold line 40 is disposed over the bag member such that the fold line of the book is aligned with the line of perforations 28 on the bag member and the central fold line 14 connecting the first and second panel members. The book and the bag member are secured to the first and second panels by staples or other suitable fastening means at the location of the aligned central fold line 14 of the panels, the line of perforations 28 on the bag member and the fold line 40 of the children's book. The pages of the book contain a written story and corresponding scenes which may relate to the games and puzzles provided on the inner surfaces of the first and second panels and to the message or title inscribed on the outer surface of the first panel. The book may be formed of a grease resistant material or may be chemically treated to achieve a similar effect.

The first and second panels are each provided with a handle portion 42 proximate their external edges opposite the central fold line 14. The handle portion of each panel is defined by the external edge 44 of the panel and by a line of perforations 46 provided on the panel proximate its external edge. A handle mechanism is formed on each handle portion between the line of perforations and the external panel edge. The handle mechanism comprises, in combination, an aperture 48 formed in the second panel 12 and a corresponding partially cut out portion 50 provided in the first panel 10. The aperture 48 is defined by generally straight parallel upper and lower edges 52,54 and semicircular side edges 56. A downwardly facing semicircular cut 58 is provided in the second panel between the upper edge 52 of the aperture and the external edge 44 of the second panel to form a semicircular tab. The partially cut out portion 50 provided on the first panel is defined by a generally straight lower edge 60, and semicircular side edges 62. Side edges 62 terminate in an upper fold line 64 parallel to lower edge 60. A similar semicircular tab is formed by a downwardly facing semicircular cut 66 provided in the partially cut out portion. An upwardly facing semicircular cut 68 is provided between the upper fold line 64 of the partially cut out portion and the external edge 44 of the first panel to form an additional semicircular tab.

In utilization of the combination food carrier and amusement device, the first and second panels with the bag member and children's book affixed thereto may be folded inwardly toward each other and may be stacked in vertical arrangement on a counter or support surface with the outer surface of the first panel facing upwardly. When it is desired to use the device as a carrier for food items, the restaurant employee merely opens the device by moving the panels outwardly away from each other so that the inner surfaces of the first and second panels are exposed. The restaurant worker then inserts food items, such as hamburgers and french fries, in respective portions of the bag member. The carrier is closed by moving the first and second panels inwardly toward each other. As best shown in FIG. 4, in order to form a carrying handle, the partially cut out portion provided on the first panel is inserted into the aligned aperture formed in the second panel so that the partially cut out portion extends through the aperture and is folded upwardly against the outer surface of the second panel. The semicircular tabs formed by the semicircular cuts provided on the partially cut out portion of the first panel and on the handle portions of the first and second panels are in alignment and together may be bent inwardly into the panels to form a locking means which locks the handle portions in place. The carrier may be grasped with the hand through the handle portions to provide a novel and efficient means for transporting various food items, being particularly adapted for use as a carrier by children.

The consumer may easily unlock the handle portion, open the carrier, and remove the food items for consumption. The interior bag portions may then be removed by severing or tearing them along the line of perforations provided on the bag member. Similarly, the handle portions on each panel may be removed by severing them from their respective panels by tearing along the lines of perforations provided on the panels. The handle portions may be provided with game pieces which may be cut out prior to discarding the handle portions and retained for use with the games provided on the inner surfaces of the panels. The subject food carrier is thus transformed into a unique and interesting children's book and amusement device of enduring value.

Figure 5:
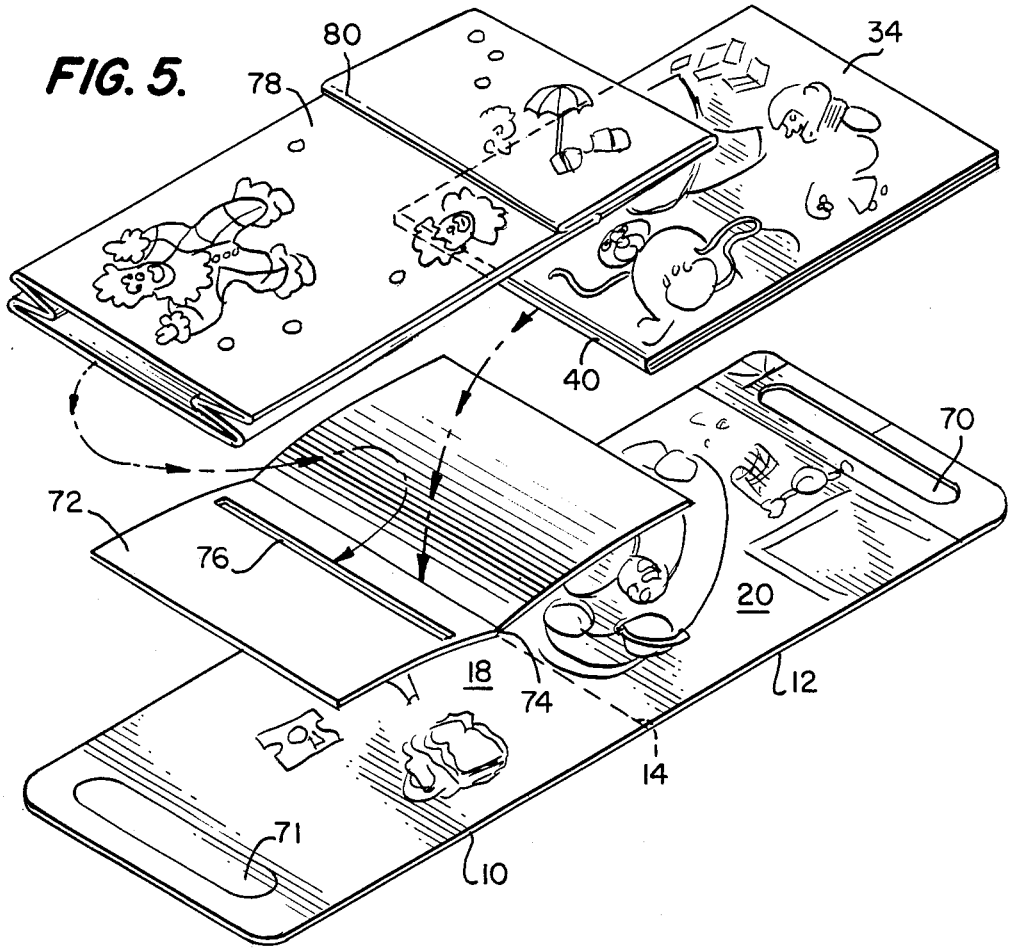
FIG. 5 is a perspective view of a first alternative embodiment of the combination food carrier and amusement device in open position and depicting the arrangement of its parts.

A first alternative embodiment of the subject food carrier and amusement device is illustrated in FIG. 5 and generally comprises first and second panels 10,12, respectively, connected by a central fold or score line 14 as was discussed in connection with the embodiment depicted in FIGS. 1–4. Similarly, the first and second panels may be provided with handle mechanisms as was discussed in connection with the embodiment of FIGS. 1–4, or may simply be provided with an aperture 70 formed in the second panel and a partially cut out portion 71 provided in the first panel. A generally rectangular bag retaining member 72, having a transverse fold or score line 74, is disposed over the inner surfaces 18,20 of the first and second panels so that the score line 74 of the bag retaining member is aligned with the central score line 14 connecting panels 10 and 12. The bag retaining member is provided with a transverse slot 76 which is adapted to receive the open end of a folded bag 78. The bag 78 is inserted into the slot and is secured to the bag retaining member by keeping the folded edge 80 of the bag outside of the slot. A children's book 34 is disposed over the bag retaining member such that the central fold line 40 of the book is aligned with the fold or score line 74 of the bag retaining member and with the central score line 14 connecting the first and second panel members. The book and the bag retaining member are secured to the first and second panels by staples or other suitable fastening means at the location of the aligned fold line 14 of the panels, the fold line 74 of the bag retaining member, and the fold line 40 of the children's book. The bag member may be removed and disposed of after use by removing it from the slot formed in the bag retaining member. The remaining features and operation of the first alternative embodiment are as discussed in relation to the embodiment of FIGS. 1–4.

Figure 6:
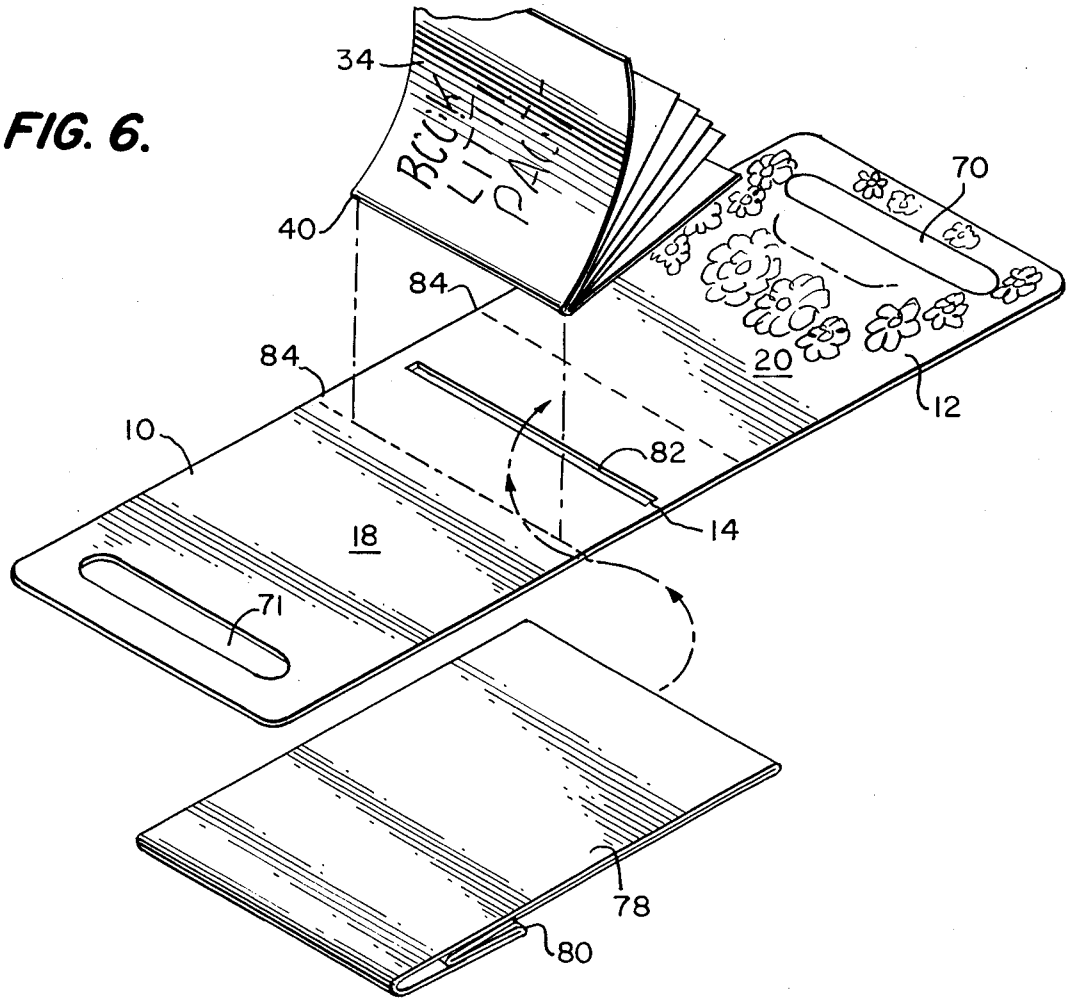
FIG. 6 is a perspective view of a second alternative embodiment of the combination food carrier and amusement device in open position and depicting the arrangement of its parts.

A second alternative embodiment of the subject food carrier and amusement device is shown in FIG. 6. As shown therein, the instant embodiment comprises generally rectangular first and second panels 10,12, respectively, connected by a central fold line 14 as was discussed in connection with FIGS. 1–4. The first and second panels may be provided with handle mechanisms as was previously discussed in connection with the embodiment illustrated in FIGS. 1–4, or may simply be provided with an aperture 70 formed in the second panel and a partially cut out portion 71 formed in the first panel. The fold line 14 is provided with a transverse slot 82 which is adapted to receive the open end of a folded bag 78. The bag 78 is inserted into the slot and is thereby secured to the first and second panels by keeping the folded edge 80 of the bag outside of the slot. A children's book 34 having a central fold line 40 is secured to the inner surface of either the first or second panels at the location of the fold line 40 by staples or other suitable fastening means. The first and second panels 10,12 may each be provided with a transverse score line 84 proximate central fold line 14 at an equal distance thereto. Book 34 may be secured to either the first or second panels at the location of this score line. The purpose of score lines 84 is to achieve a flat bottomed effect when the food carrier is assembled with food items contained therein. The flat bottomed effect thereby realized allows the assembled food carrier to stand in a vertical position on a support surface. It is to be noted that this feature may, if desired, be incorporated into any of the embodiments of the subject invention with the obvious modifications thereto. Bag member 78 may be removed from slot 82 and discarded after use.

While the foregoing has been applied to the specific illustrative embodiments, it is to be understood that various changes may be made in adapting and modifying the invention to different embodiments without departing from the broader inventive concepts disclosed herein and encompassed by the following claims.

What is claimed is:

1. A combination food carrier and amusement device comprising first and second panels connected together by means of a fold line, a removable bag member disposed between the inner surfaces of said first and second panels, said bag member being secured between said inner surfaces of said first and second panels by retaining means, a book disposed between the inner surfaces of said first and second panels, said book being secured between said inner surfaces of said first and second panels by fastening means, a handle portion provided on said first and second panels, and a handle mechanism provided on each of said handle portions, said handle mechanism including an aperture provided in said second panel and a corresponding partially cut out portion provided on said first panel.

2. The combination food carrier and amusement device of claim 1 wherein said first and second panels are each provided with a score line, said score line being located proximate said fold line at an equal distance thereto, said score lines being adapted to allow said food carrier to assume a vertical standing position.

3. The combination food carrier and amusement device of claim 1 wherein said handle portion is defined by the external edge of said panels and by a line of perforations provided on said panels.

4. The combination food carrier and amusement device of claim 1 wherein said aperture is defined by generally parallel upper and lower edges and semicircular side edges.

5. The combination food carrier and amusement device of claim 1 wherein said partially cut out portion is defined by a lower edge, semicircular side edges and an upper fold line parallel to said lower edge.

6. The combination food carrier and amusement device of claim 1 further comprising tab members formed by a downwardly facing semicircular cut provided in said second panel between said upper edge of said aperture and said external edge of said second panel, a downwardly facing semicircular cut provided in said partially cut out portion, and an upwardly facing semicircular cut provided in said first panel between said upper fold line of said partially cut out portion and said external edge of said first panel.

7. The combination food carrier and amusement device of claim 1 wherein said bag member is formed of grease resistant material.

8. The combination food carrier and amusement device of claim 1 wherein said bag member is chemically treated to be grease resistant.

9. The combination food carrier and amusement device of claim 1 wherein said inner surfaces of said first and second panels are provided with a plurality of puzzles and games.

10. The combination food carrier and amusement device of claim 1 wherein said bag member is adapted to receive food items.

11. The combination food carrier and amusement device of claim 1 wherein said bag member and said handle portions are adapted to be removed from said first and second panels.

12. The combination food carrier and amusement device of claim 1 wherein said first and second panels and said book are formed of a grease resistant material.

13. A combination food carrier and amusement device comprising first and second panels connected together by means of a fold line, said panels being adapted for movement toward or away from each other to an open or closed position, a bag member having a transverse line of perforations disposed over the inner surfaces of said first and second panels such that said line of perforations is in alignment with said fold line, said bag member having two open ends extending beyond said fold line on either side, a book having a plurality of left hand and right hand pages separated by a central fold line disposed over said bag member such that said central fold line is aligned with said line of perforations and said fold line of said first and second panels, said bag member and said book being secured to said fold line of said first and second panels, a handle portion provided on said first and second panels, each of said handle portions being defined by the external edge of said panels and by a line of perforations provided on said panels, and a handle mechanism provided on each of said handle portions, said handle mechanism including an aperture provided in said second panel and a corresponding partially cut out portion provided on said first panel, said aperture being defined by generally parallel upper and lower edges and semicircular side edges, said partially cut out portion being defined by a lower edge, semicircular side edges and an upper fold line parallel to said lower edge, said aperture being aligned with said partially cut out portion when said first and second panels are moved toward each other to a closed position, said partially cut out portion being adapted to be inserted through said aperture and folded upwardly against the outer surface of said second panel.

14. The combination food carrier and amusement device of claim 13 further comprising tab members formed, respectively, by a downwardly facing semicircular cut provided in said second panel between said upper edge of said aperture and said external edge of said second panel, a downwardly facing semicircular cut provided in said partially cut out portion, and an upwardly facing semicircular cut provided in said first panel between said upper fold line of said partially cut out portion and said external edge of said first panel, said tab members being in alignment when said first and second panels are in a closed position, said tab members being adapted to be bent inwardly into said panels to lock said handle portions in place.

15. A combination food carrier and amusement device comprising first and second panels connected together by means of a fold line, said panels being adapted for movement toward or away from each other to an open or closed position, a bag retaining member having a transverse score line disposed over the inner surfaces of said first and second panels such that said score line is in alignment with said fold line, said bag retaining member being provided with a transverse slot, said slot being adapted to receive the open end of a folded bag member, a book having a plurality of left hand and right hand pages separated by a central fold line disposed over said bag retaining member such that said central fold line is aligned with said score line and said fold line of said first and second panels, said bag retaining member and said book being secured to said fold line of said first and second panels, a handle portion provided on said first and second panels, each of said handle portions being defined by the external edge of said panels and by a line of perforations provided on said panels, and a handle mechanism provided on each of said handle portions, said handle mechanism including an aperture provided in said second panel and a corresponding partially cut out portion provided on said first panel, said aperture being defined by generally parallel upper and lower edges and semicircular side edges, said partially cut out portion being defined by a lower edge, semicircular side edges and an upper fold line parallel to said lower edge, said aperture being aligned with said partially cut out portion when said first and second panels are moved toward each other to a closed position, said partially cut out portion being adapted to be inserted through said aperture and folded upwardly against the outer surface of said second panel.

16. The combination food carrier and amusement device of claim 15 further comprising tab members formed, respectively, by a downwardly facing semicircular cut provided in said second panel between said upper edge of said aperture and said external edge of said second panel, a downwardly facing semicircular cut provided in said partially cut out portion, and an upwardly facing semicircular cut provided in said first panel between said upper fold line of said partially cut out portion and said external edge of said first panel, said tab members being in alignment when said first and second panels are in a closed position, said tab members being adapted to be bent inwardly into said panels to lock said handle portions in place.

17. A combination food carrier and amusement device comprising first and second panels connected together by means of a fold line, said panels being adapted for movement toward or away from each other to an open or closed position, said fold line being provided with a slot, said slot being adapted to receive the open end of a folded bag, a book having a plurality of left hand and right hand pages separated by a central fold line, said book being secured to the inner surface of one of said panels, a handle portion provided on said first and second panels, each of said handle portions being defined by the external edge of said panels and by a line of perforations provided on said panels, and a handle mechanism provided on each of said handle portions, said handle mechanism including an aperture provided in said second panel and a corresponding partially cut out portion provided on said first panel, said aperture being defined by generally parallel upper and lower edges and semicircular side edges, said partially cut out portion being defined by a lower edge, semicircular side edges and an upper fold line parallel to said lower edge, said aperture being aligned with said partially cut out portion when said first and second panels are moved toward each other to a closed position, said partially cut out portion being adapted to be inserted through said aperture and folded upwardly against the outer surface of said second panel.

* * * * *